US005363757A

United States Patent [19]

Newsom

[11] Patent Number: 5,363,757

[45] Date of Patent: Nov. 15, 1994

[54] METHOD AND APPARATUS FOR ADJUSTING RAM BALER PLATEN

[75] Inventor: Horace R. Newsom, Waco, Tex.

[73] Assignee: Harris Waste Management Group, Inc., Peachtree City, Ga.

[21] Appl. No.: 998,468

[22] Filed: Dec. 30, 1992

[51] Int. Cl.[5] ..... B30B 13/00; B30B 9/00

[52] U.S. Cl. ..... 100/39; 100/98 R; 100/245

[58] Field of Search ..... 100/98 R, 179, 188 R, 100/190, 245, 39

[56] References Cited

U.S. PATENT DOCUMENTS

| | | | |
|---|---|---|---|
| 2,489,198 | 11/1949 | Russell | 100/98 R X |
| 2,720,160 | 10/1955 | Tice et al. | 100/98 R |
| 2,923,230 | 2/1960 | Bornzin | 100/98 R |
| 3,059,569 | 10/1962 | Nolt | 100/98 R |
| 3,249,040 | 5/1966 | Van Der Lely | 100/98 R |
| 3,906,852 | 9/1975 | Robinson, Jr. et al. | 100/98 R |
| 5,007,337 | 4/1991 | Newsom | 100/188 |
| 5,081,922 | 1/1992 | Rudd, Jr. et al. | 100/50 |

OTHER PUBLICATIONS

*Thunderbird Two-Ram Balers,* brochure, Ross Corporation, 1991.

*Thunderbird Unitizer,* leaflet, Ross Corporation.

*Recycling+Solid Waste Management Systems,* C+M, Application Notes P-AN90-1.

*Primary Examiner*—Stephen F. Gerrity

*Attorney, Agent, or Firm*—Kirkpatrick & Lockhart

[57] ABSTRACT

A ram baler (20) having a platen (28) coupled to a plunger (26). A first cutting edge (32) is attached to platen (28) and a second cutting edge (30) attached to baler (20). Platen (28) includes a top assembly (27) for attachment of the first cutting edge (32). A bottom plate assembly (46) is included for forming a lower surface of platen (28). Top assembly (27) is vertically moveable with respect to bottom plate assembly (46). Platen (28) houses an adjuster assembly (110) for varying the distance between top assembly (27) and bottom plate assembly (46).

14 Claims, 5 Drawing Sheets

METHOD AND APPARATUS FOR ADJUSTING RAM BALER PLATEN

TECHNICAL FIELD OF THE INVENTION

The present invention relates generally to devices for baling material such as trash or recyclable material, and more specifically relates to improvements in multiple ram balers for forming and ejecting bales of such material.

BACKGROUND OF THE INVENTION

Balers, specifically two ram balers, are commonly used to compress recyclable or waste material such as aluminum cans and the like into bales and then to strap the bales in order to facilitate transportation of the materials. Examples of such two ram balers are described in U.S. Pat. No. 5,007,337, entitled "Oversize Bale Release Mechanism For Waste Material Baler" and U.S. Pat. No. 5,081,922, entitled "Device for Controlling the Discharge of a Bale from a Solid Waste Baling Machine." These balers generally comprise a hopper for storing and feeding the material to be baled and a baling chamber in which the bale is formed. A main compression ram comprising a hydraulic plunger and platen is operated within the chamber to compress the material into the shape of the bale, and a smaller ram ejects the bale into the strapping device. Two knives or cutting edges are often used in order to separate the material in the hopper from the material in the baling chamber. One such cutting edge, the top cutting edge, is fixed to the top edge of the baling chamber where the material enters from the hopper. The other cutting edge, the bottom cutting edge, is attached to the top edge of the platen. As the hydraulic plunger extends, the top edge of the platen moves underneath the top of the baling chamber. Consequently, the two cutting edges meet in a scissor-type action to cut and separate material in the hopper from material in the baling chamber.

A problem arises as the bottom surface of the platen, which rides on the baling chamber floor, wears out, and the distance between the two cutting edges increases. As the distance increases, the cutting efficiency is reduced, much like the cutting efficiency of scissors is reduced if the connecting rivet loosens. As the cutting efficiency is reduced, total separation of the material is not accomplished. Damage to the baler may also occur.

This problem has been previously solved in one of two ways. The first technique is an adjustable top for the ceiling of the baling chamber. The top of the baling chamber is placed on shims and secured with bolts. As the bottom surface of the platen wears out, thus increasing the distance between the two cutting edges, the top of the baling chamber is removed. A number of shims are removed and the top of the chamber is reinstalled. The second method is to install shims underneath the floor of the baling chamber. As the bottom of the platen wears out, the number of shims is increased, thereby raising the platen and the lower cutting edge to the optimal level.

A problem with both of the above methods is that it takes substantial time and effort to remove the proper part at the proper time, change the number of shims, and then reinstall the removed part of the baler.

Another problem with the prior methods is that the baler operator is often not qualified to perform the adjustment. Professional service help must then be called in, resulting in more down time for the baler. Even where the operators are qualified to perform the adjustment, the time and effort required often results in the operator neglecting to correct the cutting edge distance when necessary. This neglect may result in inefficient baling or damage to the baler.

SUMMARY OF THE INVENTION

In accordance with the present invention, a ram baler is provided which substantially eliminates or reduces disadvantages and problems associated with prior ram balers.

A ram baler includes a platen coupled to a hydraulic plunger, a first cutting edge attached to the platen and a second cutting edge attached to the baler. The platen includes a top assembly for attachment of the first cutting edge and further includes a bottom plate assembly which forms a lower surface of the platen and is moveable with respect to the top assembly. An eccentric adjuster assembly, housed inside the platen, selectively increases the distance between the top assembly and the bottom plate assembly.

In a more specific aspect of the invention, an eccentric adjuster assembly includes an eccentric adjuster pin, with structure for supporting both ends of the eccentric adjuster pin. A shoe is suspended on an eccentric portion of the eccentric adjuster pin for bearing on the bottom plate assembly. An adjusting arm is provided for rotating the eccentric adjuster pin, wherein the eccentric portion exerts a first force on the shoe and a second force on the supporting structure as the eccentric adjuster pin is rotated in a first direction.

Additionally, the bottom plate assembly includes a bottom plate and a liner. The liner is coupled to the underside of the bottom plate for abutting a portion of the chamber floor. The bottom plate assembly also includes a reverse motion stop. The reverse motion stop is coupled to a first portion of the top side of the bottom plate for transferring motion from the face plate to the bottom plate during a retraction of the hydraulic plunger. Further included is a forward motion pusher bar coupled to the hydraulic plunger. A forward motion stop is included in the bottom plate assembly. The forward motion stop is coupled to a second portion of the top side of the bottom plate for transferring motion from the forward motion pusher bar to the bottom plate during an extension of the hydraulic plunger.

A first technical advantage of this invention is that the height of a bottom cutting edge affixed to the top of the platen can be adjusted without having to remove any portions of the ram baler.

A second technical advantage is the height of both sides of the cutting edge can be adjusted independently.

A third technical advantage is the bottom plate assembly can easily be removed to replace the bottom liner without removing the whole platen from the ram baler.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
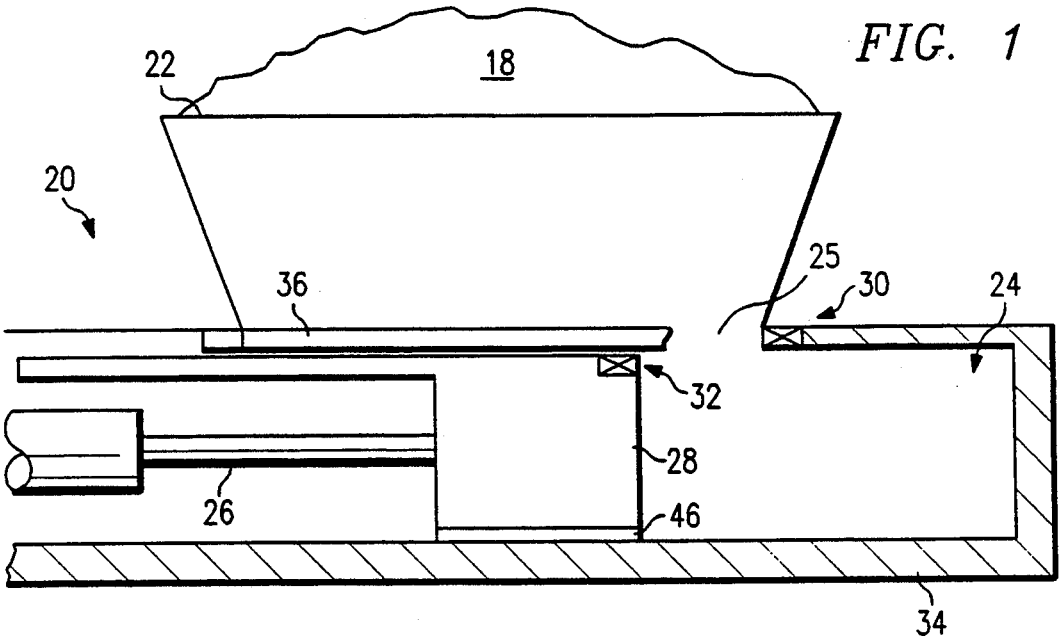
FIG. 1 shows a view of one side of a ram baler.

The preferred embodiment of the present invention and its advantages are best understood by referring to FIGS. 1–7 of the drawings, like numerals being used for like and corresponding parts of the various drawings.

In accordance with the invention, a two-ram baler 20 includes a platen 28 having a bottom plate assembly 46 that is moveable in a vertical direction with respect to the rest of platen 28. The height of platen 28 is manually adjustable in order that the height of a bottom cutting edge 32 is adjustable. This height adjustment compensates for the wear of a bottom plate liner 96.

Figure 2:
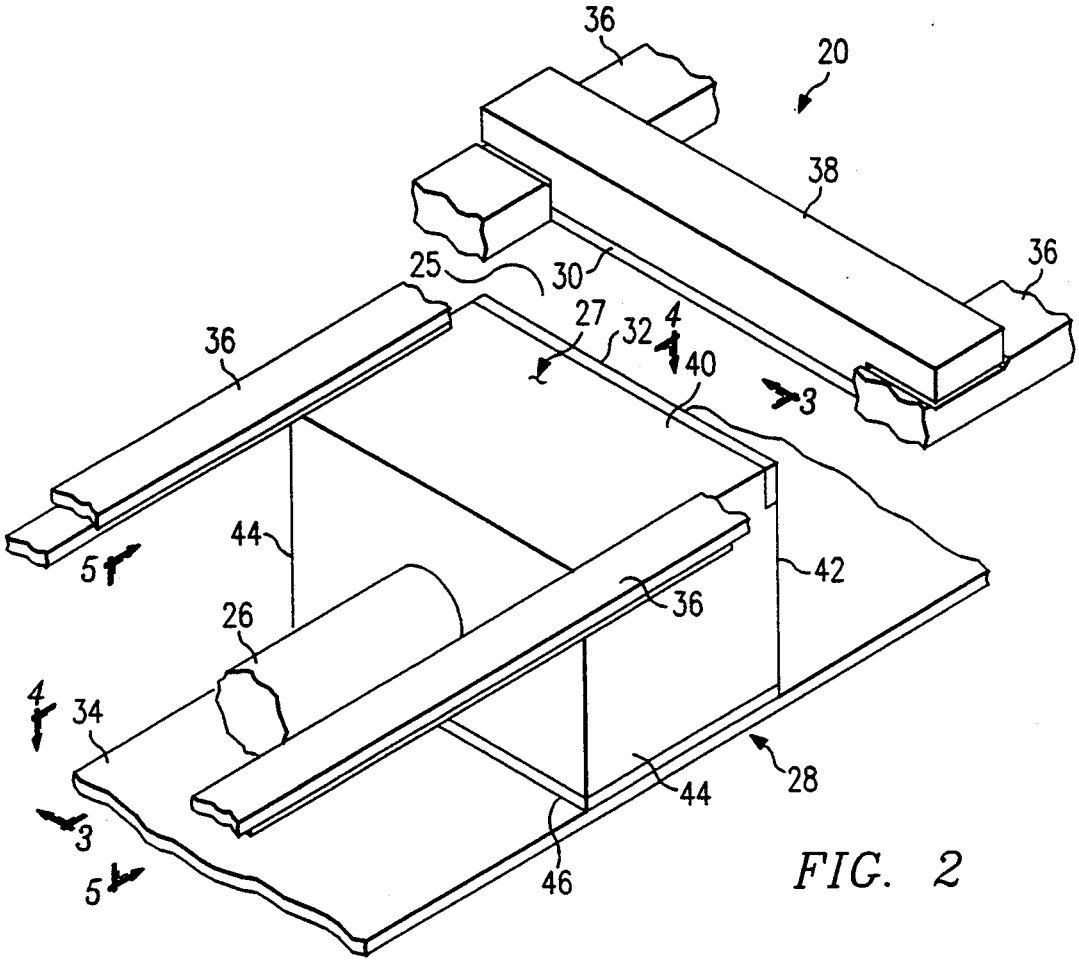
FIG. 2 shows a top cutaway view of the ram baler of FIG. 1.

FIGS. 1 and 2 show two-ram baler 20 having a bottom plate assembly 46 in accordance with the invention. FIG. 1 shows a side view of two-ram baler 20. A material 18 to be baled is loaded into a hopper 22 and is gravity-fed into a baling chamber 24 through a baling chamber opening 25. A hydraulic plunger 26 moves platen 28 back and forth. On its forward motions, platen 28 compresses material 18 inside baling chamber 24. As platen 28 is retracted by plunger 26, material 18 from hopper 22 falls into chamber 24 and the cycle is repeated until chamber 24 is full with a compressed bale.

When chamber 24 is almost full, material will pile up and this pile will extend into hopper 22 through baling chamber opening 25. This material is cut or separated by the scissor-like action of a top cutting edge 30 and bottom cutting edge 32, as platen 28 moves into the baling chamber 24. Bottom cutting edge 32 is supported by top assembly 27. A floor 34 of the two-ram baler 20 supports platen 28 as it slides back and forth. Holding bars 36 prevent platen 28 from "riding up" beyond the level of holding bars 36.

FIG. 2 is a partial isometric view of platen 28 and its interface with top cutting edge 30. A top cutting edge support 38 is secured to holding bars 36 whereas bottom cutting edge 32 is secured to a top assembly 27 of platen 28. Top assembly 27 has a roof plate assembly 40 and a face plate assembly 42 at whose intersection is attached bottom cutting edge 32. Sidewalls 44 of platen 28 are also shown. Bottom plate assembly 46 of platen 28 is shown abutting the surface of floor 34. Neither face plate assembly 42 nor sidewalls 44 are attached to bottom plate assembly 46.

Figure 3:
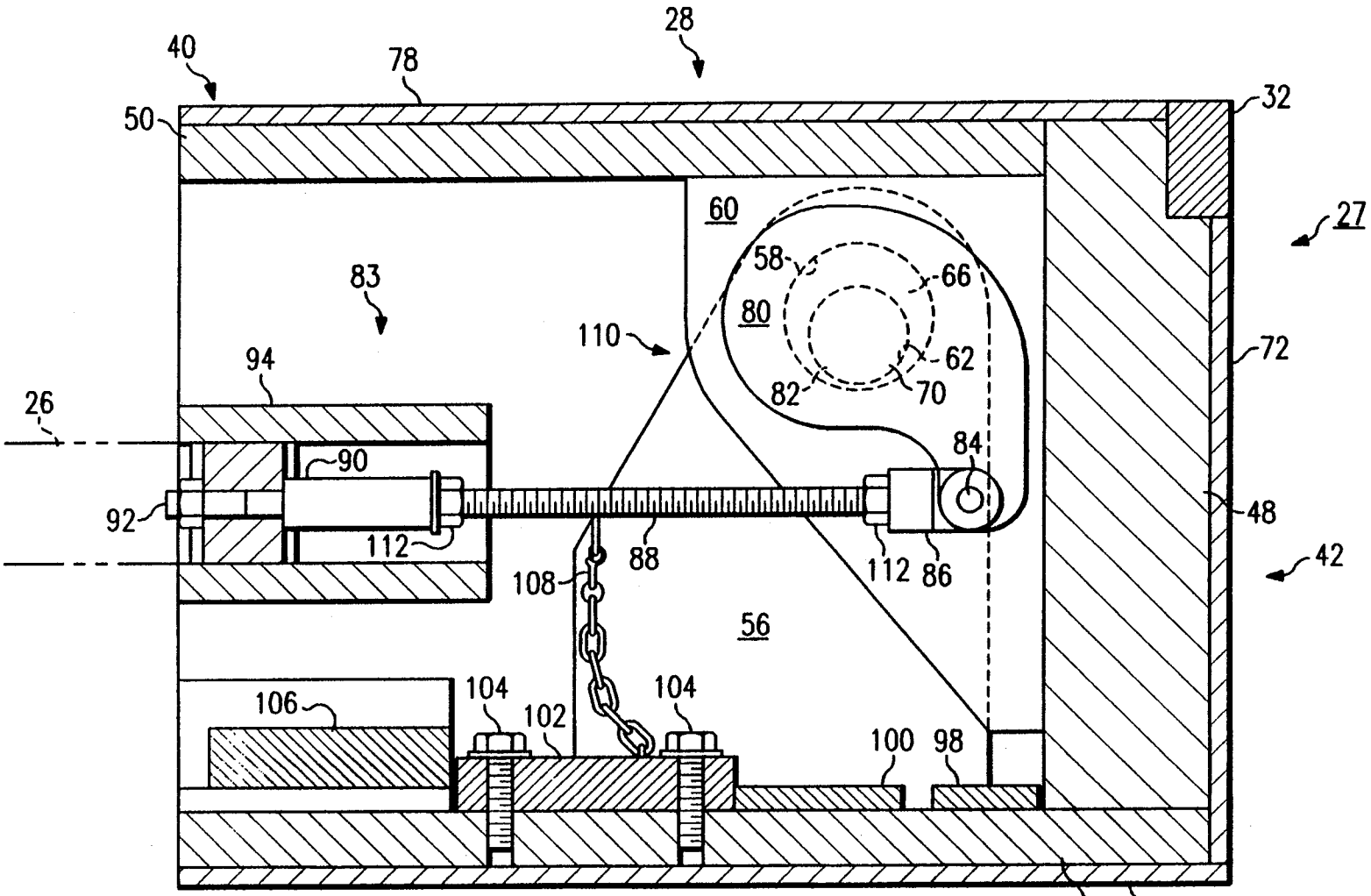
FIG. 3 shows a cutaway side view of one side of a platen.
Figure 4:
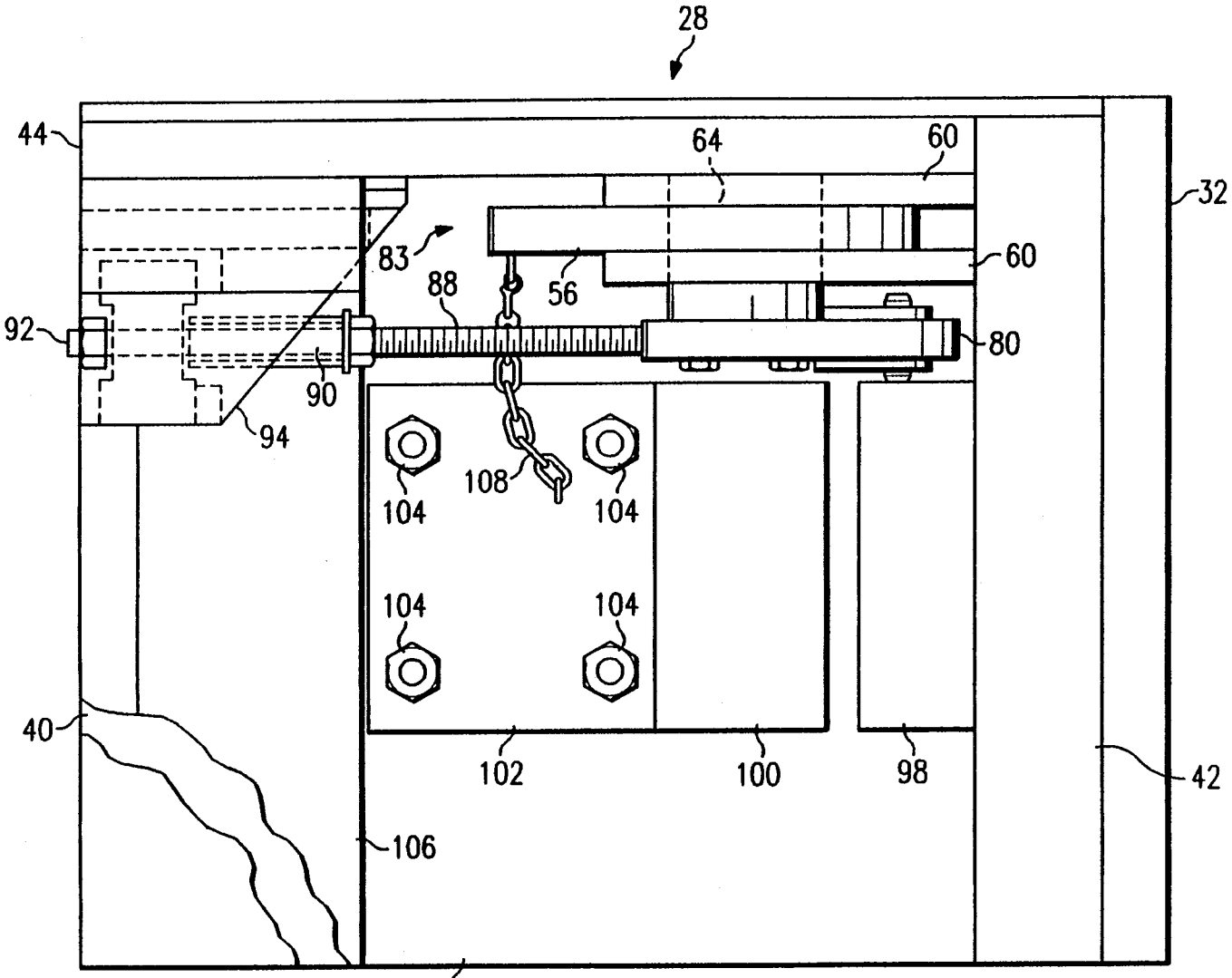
FIG. 4 shows a cutaway top view of the platen of FIG. 3.
Figure 5:
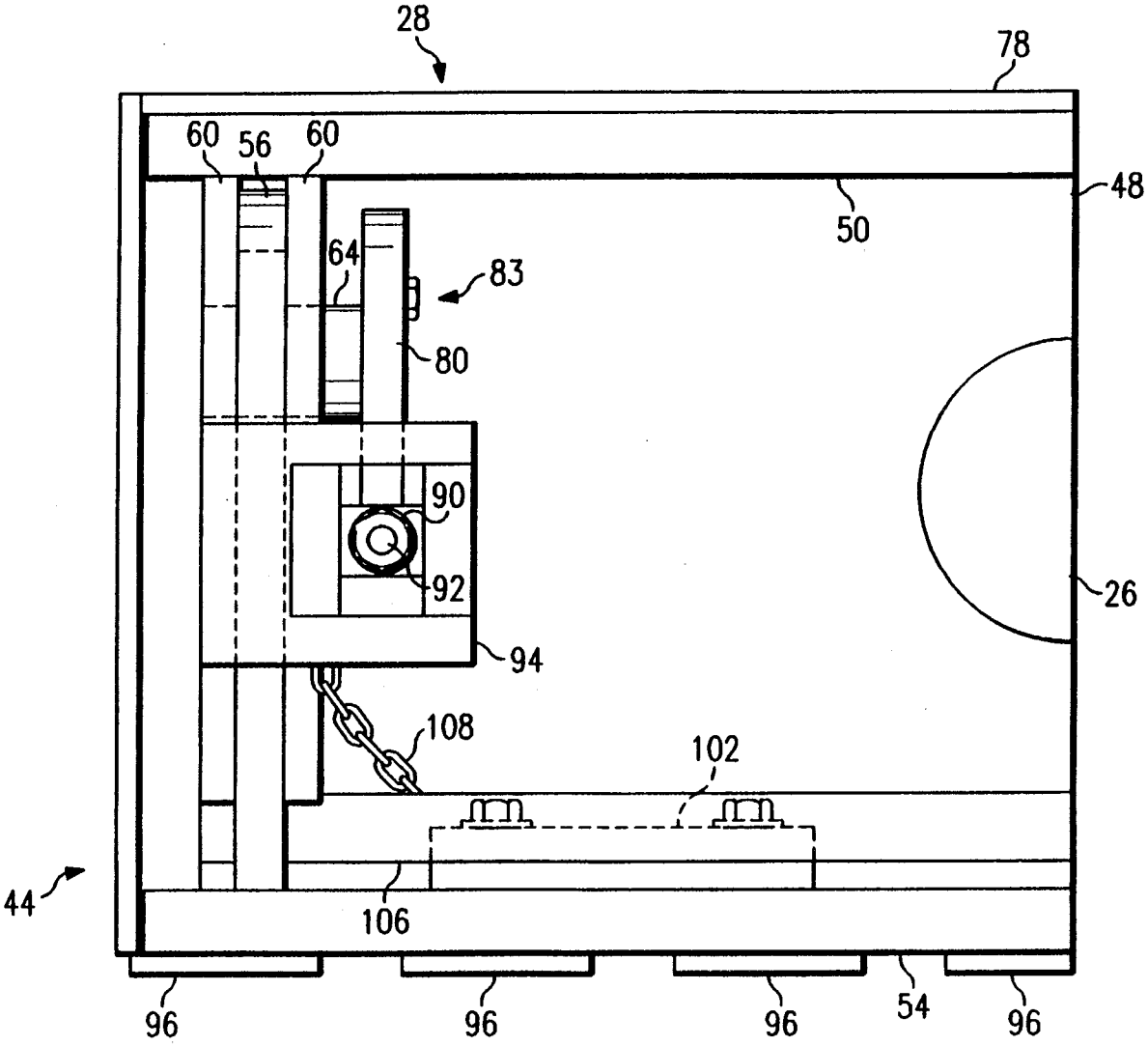
FIG. 5 shows a partial rear view of the platen of FIG. 3.

FIGS. 3–5 are cross-sectional views of platen 28. FIG. 3 is a cross-section view of platen 28 along lines 3—3 of FIG. 2. FIG. 4 is a cut-away top view of platen 28 along lines 4—4. FIG. 5 is a rear view of platen 28 along lines 5—5. The other side of platen 28 is constructed identically to the illustrated side.

Referring to FIGS. 3–5, face plate assembly 42 has a face plate 48 which is coupled to hydraulic plunger 26. Roof plate assembly 40 has a roof plate 50 intersecting a portion of face plate 48. Bottom cutting edge 32 is attached to this intersection. A bottom plate 54 of bottom plate assembly 46 is shown on which the bottom edge of a shoe 56 can rest. Bottom plate assembly 46 forms the bottom of platen 28.

Figure 6:
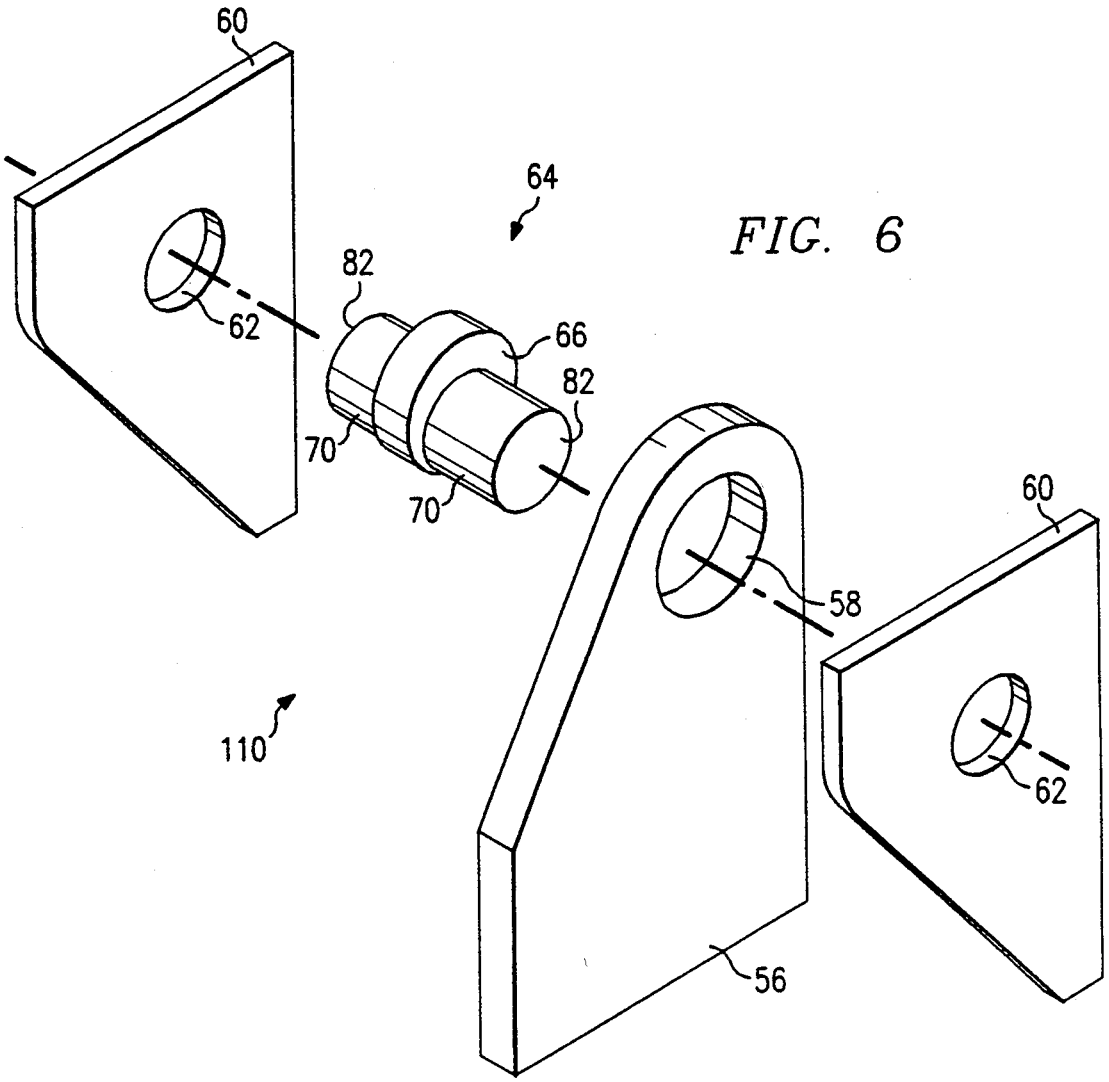
FIG. 6 shows a more detailed view of a bearing support, an eccentric adjustor, a shoe and an eccentric adjustor arm.

An eccentric adjuster assembly 110, discussed more fully in conjunction with FIG. 6, is housed inside platen 28. Its main components include shoe 56 having a hole 58, a pair of bearing supports 60 having holes 62, spaced apart from each other and fixedly attached to top assembly 27. This attachment may be made directly to face plate assembly 42 or indirectly, by attachment to roof plate assembly 40, which is fixedly attached to face plate assembly 42. An eccentric adjuster pin 64, described more fully hereinafter, is placed between bearing supports 60. Shoe 56 is suspended from pin 64. An adjuster arm 80 is attached to pin 64 and via an adjusting assembly 83 may be rotated to turn pin 64. Adjusting assembly 83 includes a rivet or screw 84, a clevis 86, a threaded shaft 88, a swivel nut 90, an adjusting screw 92, and jam nuts 112. Shoe 56 is shown having a hole 58 in its upper portion. Shoe 56 is inserted between bearing supports 60 which are attached, preferably welded, to roof plate 50 and to face plate 48. Hole 58 of shoe 56 aligns with holes 62 in bearing supports 60. Eccentric adjustor pin 64 is inserted through holes 62 of bearing supports 60 and through hole 58 of shoe 56. A center portion, or eccentric portion, 66 of eccentric adjustor pin 64 is aligned in a vertical plane with an edge 68 of hole 58. A portion of each bearing end 70 of eccentric adjustor pin 64 is supported by bearing supports 60. In this way, shoe 56 could hang and be supported by eccentric adjustor pin 64 if shoe 56 were not supported by bottom plate assembly 46.

Face plate 48 has a face plate liner 72 attached to it. Face plate 48 is attached to plunger 26. Roof plate 50 has attached a roof plate liner 78. Both roof plate liner 78 and face plate liner 72 are designed to be replaced as they wear out from continued movement of platen 28.

Eccentric adjuster assembly 110 further comprises an eccentric adjustor arm 80. In the preferred embodiment, arm 80 is curved with one end being attached to a bearing surface 82 of eccentric adjustor pin 64. The other end of eccentric adjustor arm 80 is attached to threaded shaft 88 via clevis 86. Clevis 86 is attached to an end of threaded shaft 88 whose opposite end is attached to swivel nut 90. The opposing end of swivel nut 90 includes adjusting screw 92. Swivel nut 90 is supported by a support member 94.

In one embodiment of platen 28, face plate 48 is not coupled or attached in any way to bottom plate 54. Bottom plate 54 includes a replaceable liner 96 which, like face plate liner 72 and roof plate liner 78, is replaceable when it wears out from the friction caused by movement of platen 28 against floor 34 of two ram baler 20. A reverse motion stop 98 is attached to a first portion of the top side of bottom plate 54 as shown in FIGS. 3 and 4. A forward motion stop 100 is welded to a second portion of the top side of bottom plate 54. A disassembly stop 102 is bolted to bottom plate 54 by bolts 104. A forward motion push bar 106 is attached to hydraulic plunger 26. One end of a chain 108 is coupled to shoe 56 with the other end of chain 108 being coupled to disassembly stop 102. Jam nuts 112, when tightened, prevent rotation of threaded shaft 88.

FIG. 6 is an expanded view of eccentric adjuster assembly 110 which includes bearing supports 60, eccentric adjustor pin 64, shoe 56, and adjustor arm 80. Eccentric adjustor pin 64 has an eccentric center portion 66 and bearing end portions 70 extending from each side of this eccentric center portion 66. As can be seen from FIG. 3, eccentric adjustor pin 64 is first inserted through hole 58 of shoe 56. Then, each of bearing supports 60 is positioned so that each bearing end 70 is inserted in a corresponding hole 62 of bearing supports 60. Eccentric adjustor arm 80 is then welded, or otherwise attached, to one bearing surface 82 which protrudes through hole 62 of one of bearing supports 60. Bearing supports 60 are then welded, or otherwise attached, to platen 28. Eccentric center portion 66 is aligned inside hole 58 of shoe 56.

In operation, if eccentric adjustor pin 64 is turned via adjusting screw 92, the vertical distance between the top of bearing support 60 and the bottom of shoe 56 changes depending upon the relative orientation of center portion 66 of eccentric adjustor pin 64. As eccentric adjuster pin 64 is rotated, it exerts a downward force on bottom plate assembly 46 via shoe 56, and an upward force on top assembly 27 via bearing supports 60. Since bottom plate assembly 46 is not attached to face plate assembly 42, that is, bottom plate assembly 46 is "floating", platen 28 (all portions except bottom plate assembly 46) is raised or moved upward. (Bottom plate assembly 46 cannot be lowered or moved downward because it rests on floor 34 of baler 20.)

As platen 28 is extended and retracted by hydraulic plunger 26, bottom plate shoe liner 96 wears out. That is, bottom plate shoe liner 96 slowly becomes thinner due to wear as platen 28 is extended and retracted. As bottom plate shoe liner 96 wears out, bottom cutting edge 32 of platen 28 begins to get closer to floor 34. In order to raise bottom cutting edge 32 to the proper level, adjusting screw 92 is rotated, which in turn rotates threaded shaft 88 in the same direction. As threaded shaft 88 is rotated, the distance between swivel nut 90 and clevis 86 increases or decreases. As a result, eccentric adjustor arm 80 is moved either toward the front of platen 28 or toward the back of platen 28.

Figure 7:
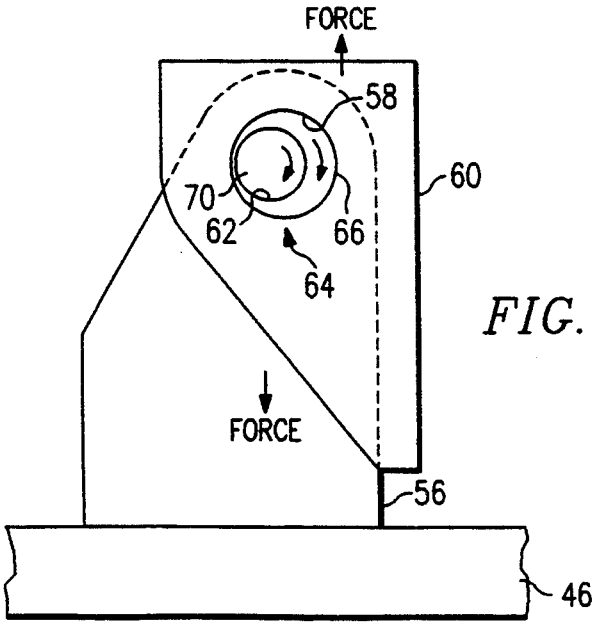
FIG. 7 is an illustration of a height adjustment of the platen of FIGS. 3–5.

In one embodiment, as eccentric adjustor arm 80 moves toward the rear of platen 28, eccentric adjustor pin 64 is rotated in a clockwise direction. As FIG. 7 illustrates, when eccentric adjustor pin 64 is rotated in a clockwise direction, its eccentric center portion 66 begins to exert a force on shoe 56. Since shoe 56 cannot force bottom plate assembly 46 any lower, (bottom plate assembly 46 rests on baler floor 34), top assembly 27 is raised upward. Because bottom plate 46 is not attached to top assembly 27, it remains abutting floor 34 of the two ram baler 20. Adjusting screw 92 is adjusted until the bottom cutting edge 32 is at the proper height. Then, the two jam nuts 112 on threaded shaft 88 are tightened to prevent threaded shaft 88 from further rotation, thus locking the eccentric adjustor arm 80 in the desired position and bottom cutting edge 32 at the desired height.

An identical structure as shown in FIGS. 3–5 is present on the opposite side of platen 28. In this way, the height of each end of bottom cutting edge 32 can be adjusted independently. This allows the operator to compensate for uneven wear of bottom plate liner 96.

Further in operation, as platen 28 is extended, forward motion push bar 106 exerts a forward force on disassembly stop 102, which in turn exerts a forward force both on bottom plate 54 via bolts 104 and on forward motion stop 100, which also exerts a forward force on bottom plate 54. When platen 28 is retracted, face plate 48 exerts a rearward force on reverse motion stop 98 which exerts a rearward force on bottom plate 54. In this way, bottom plate assembly 46 remains in the same position underneath platen 28 as platen 28 is moved.

When bottom plate shoe liner 96 wears to a predetermined thickness, it must be replaced. To facilitate in the removal of bottom plate assembly 46, which must be removed to replace bottom plate liner 96, it is possible to slide bottom plate assembly 46 out underneath forward motion push bar 106 towards the rear of platen 28. This is accomplished by removing bolts 104 and then removing disassembly stop 102. The clearance between forward motion push bar 106 and forward motion stop 100 and reverse motion stop 98 is great enough to allow the bottom plate assembly 46 to be slid out from the rear of platen 28 underneath forward motion push bar 106. Once the base plate assembly 46 is removed, bottom plate liner 96 can be replaced and the bottom plate assembly 46 can be reinstalled by sliding it under forward motion push bar 106 and reinstalling disassembly stop 102.

Referring again to FIGS. 3–5, chain 108 provides a safety feature in the circumstance that platen 28 is removed from the top of ram baler 20. Without chain 108, as platen 28 was lifted out, the bottom plate assembly 46 would remain in the baler 20 and roof plate assembly 40 along with face plate assembly 42 and the other attached contents of platen 28 would be removed. However, after prolonged operation of ram baler 20, it is possible that the reverse motion stop 98 and disassembly stop 102 can be wedged in between forward motion push bar 106 and face plate 48 by dirt or other foreign material, in which case the bottom plate assembly 46 would be removed along with the rest of platen 28. It is possible that as the platen 28 is removed, bottom plate assembly 46 may become dislodged, fall and be damaged. With chain 108 attached between disassembly stop 102 and shoe 56, if bottom plate assembly 46 became dislodged, chain 108 would prevent bottom plate assembly 46 from falling and becoming damaged. That is, bottom plate assembly 46 would hang from platen 28 and not fall to the ground.

Although the present invention and its advantages have been described in detail, it should be understood that various changes, substitutions and alterations can be made therein without departing from the spirit and scope of the invention as defined by the appended claims.

What is claimed is:

1. A ram baler comprising:

a platen for compressing material, said platen including a top assembly and a bottom assembly;

said bottom assembly having a generally rectangular configuration including a bottom plate and a replaceable liner with said replaceable liner extending over substantially the full length and width of said bottom plate;

a bottom cutter attached to said top assembly for cutting said material;

a top cutter attached to the ram baler for cutting said material, said top cutter a first vertical distance from said bottom cutter wherein said bottom cutter and said top cutter cooperate for cutting said material within said baler;

a first adjuster assembly, housed inside said platen, for varying a second vertical distance between said bottom assembly and said top assembly; and wherein said adjuster assembly adjusts said first vertical distance to compensate for wear of said bottom assembly.

2. The ram baler of claim 1 further comprising;

a second adjuster assembly, housed inside said platen; and wherein said first adjuster assembly is for varying said second vertical distance at a first side of said platen, and said second adjuster assembly is for varying said second vertical distance at a second side of said platen.

3. The ram baler of claim 1 wherein said adjuster assembly further comprises:

a rotatable adjuster pin having opposing ends;

means for supporting said opposing ends; and a shoe suspended on a portion of said adjuster pin for bearing on said bottom assembly when said adjuster pin is rotated.

4. The ram baler of claim 3 wherein said supporting means is attached to said top assembly.

5. The ram baler of claim 3 wherein said portion of said adjuster pin is eccentric.

6. A ram baler comprising:

a platen for compressing material, said platen including a top assembly and a bottom assembly;

a bottom cutter attached to said top assembly for cutting said material;

a top cutter attached to the ram baler for cutting said material, said top cutter a first vertical distance from said bottom cutter wherein said bottom cutter and said top cutter cooperate for cutting said material within said baler; and an adjuster assembly, housed inside said platen, for varying a second vertical distance between said bottom assembly and said top assembly, thereby adjusting said first vertical distance to compensate for wear of said bottom assembly, said adjuster assembly comprising:

a rotatable adjuster pin having opposing ends;

means for supporting said ends of said adjuster pin; and a shoe, suspended from a portion of said adjuster pin, for bearing on said bottom assembly when said adjuster pin is rotated.

7. The ram baler of claim 4 wherein said supporting means is attached to said top assembly.

8. The ram baler of claim 6 wherein said portion of said adjuster pin is eccentric.

9. A ram baler having a platen coupled to a plunger, a first cutting edge attached to the platen, and a second cutting edge attached to the baler wherein first cutting edge and said second cutting edge cooperate for cutting said material within said baler, the platen comprising:

a bottom plate assembly forming a lower surface of the platen, the platen vertically moveable with respect to said bottom plate assembly; and an adjuster assembly, housed inside the platen, for varying the distance between the first cutting edge and said bottom plate assembly, said adjuster assembly comprising:

an adjuster pin having opposing ends;

means for supporting said opposing ends; and a shoe suspended from a portion of said adjuster pin for bearing on said bottom plate assembly.

10. The ram baler of claim 9 further comprising:

an adjusting arm for rotating said adjuster pin; and wherein said portion exerts a first force on said shoe and a second force on said supporting means as said adjuster pin is rotated.

11. The ram baler of claim 10 wherein said portion of said adjuster pin is eccentric.

12. A method for adjusting the cutting assembly of a ram baler comprising the steps of:

providing a platen having a top assembly and a bottom assembly;

attaching a bottom cutter to said top assembly;

attaching a top cutter to the ram baler a first vertical distance from said bottom cutter wherein said bottom cutter and said top cutter cooperate for cutting said material within said baler;

adjusting said first vertical distance to compensate for wear of said bottom assembly by varying a second vertical distance between said bottom assembly and said top assembly with a first adjusting mechanism housed inside said platen;

providing said first adjusting mechanism with a rotatable adjusting pin having opposing ends;

supporting said opposing ends from said top assembly;

suspending a shoe from a portion of said adjusting pin; and rotating said adjusting pin to force said shoe against said bottom assembly.

13. The method of claim 12 further comprising the steps of:

housing a second adjusting mechanism within said platen;

varying said second vertical distance at a first side of said platen with said first adjusting mechanism; and varying said second vertical distance at a second side of said platen with said second adjusting mechanism.

14. The method of claim 12 wherein the step of adjusting further comprises the step of:

providing an eccentric portion on said adjusting pin.

* * * * *